United States Patent [19]

Mooy

[11] 4,356,757

[45] Nov. 2, 1982

[54] MUSICAL DRUM CONSTRUCTION

[76] Inventor: Michael G. Mooy, 130 W. Figueroa St., Santa Barbara, Calif. 93101

[21] Appl. No.: 150,884

[22] Filed: May 19, 1980

[51] Int. Cl.[3] ..... G10D 13/02

[52] U.S. Cl. ..... 84/411 R

[58] Field of Search ..... 84/411 R, 420

[56] References Cited

U.S. PATENT DOCUMENTS

| | | | |
|---|---|---|---|
| 2,485,985 | 10/1949 | Perry | 84/411 R |
| 3,019,685 | 2/1962 | Davis | 84/411 R |
| 4,206,681 | 6/1980 | Kluczynski et al. | 84/411 R |
| 4,214,504 | 7/1980 | Rex | 84/411 R |

FOREIGN PATENT DOCUMENTS

| | | | |
|---|---|---|---|
| 604891 | 5/1960 | Italy | 84/411 R |
| 6369 | of 1903 | United Kingdom | 84/411 R |
| 1435902 | 5/1976 | United Kingdom | 84/411 R |

*Primary Examiner*—L. T. Hix
*Assistant Examiner*—Alan Mathews
*Attorney, Agent, or Firm*—Spensley, Horn, Jubas & Lubitz

[57] ABSTRACT

The new musical drum construction is disclosed which comprises a cylindrical sleeve disposed coaxially within a drum shell such that there is a small space between the outer edge of the sleeve and the inner edge of the drum shell. The sleeve is secured in place by rings at each end which extend between the edge of the sleeve and the edge of the drum shell. The drum heads are attached only to the shell, permitting the sleeve to resonate with the heads. This has been found to produce a distinctly clearer, more solid sound than other drums.

5 Claims, 4 Drawing Figures

⅓ OCTAVE DECAY SPECTRUM ANALYSIS

MUSICAL DRUM CONSTRUCTION

BACKGROUND OF THE INVENTION

1. Field of the Invention

This invention relates to musical drums, and more particularly, to a sleeve to be disposed within the shell of the drum such that there is a space between the shell and the sleeve, resulting in a purer tone.

2. Prior Art

The purity of the tone of a musical drum, as with any other acoustic instrument, depends largely on its resonant characteristics which are determined to a considerable degree by the design of the shell of the drum and any other parts which may resonate. In the design of a drum, it is desired to optimize the attack, the actual sound at the moment the drum is struck. The decay, or overtone should be as consistent as possible. Yet the structural and mechanical requirements of drum design all tend to reduce or distort these characteristics. The overall object is that the distortion factor should be as small as possible.

Prior musical drums have been designed in several ways in order to achieve such features and obtain a tone of reasonable purity. Since the shell of the drum is one of the main resonators, special attention has been paid to the shell. For example, making the inside surface of the shell as smooth as possible results in a somewhat purer tone. Also, since the resonation of the drum shell is cut drastically by hardware, such as lugs, hoops, shell mounts, legs, etc., certain prior art designs have attempted to modify the hardware or their method of attachment to the shell in order to improve the tone. However, none of the prior art designs has been able to result in a significantly improved drum tone than has heretofore been achieved.

BRIEF SUMMARY OF THE INVENTION

It is therefore an object of this invention to provide a musical drum wherein the attack is much higher than the prior art, the decay is much more consistent, and the distortion factor is significantly improved.

It is a further object of this invention to provide a cylindrical sleeve of unique design which can be inserted into prior art drum shells in order to significantly improve their tone.

According to the present invention, a cylindrical plastic sleeve of diameter slightly less than the inner diameter of a cylindrical drum shell is disposed coaxially within the drum shell. Preferably the height of the sleeve is slightly less than the height of the drum shell.

In the preferred embodiment, the sleeve is secured within the drum shell by a pair of rings, one at the top and one at the bottom, which are configured such that a groove at the inner edge of the ring engages and is bonded to the edge of the sleeve about its circumference. The ring extends outwardly in both a radial and an axial direction to engage the edge of the drum shell about its circumference. A flange on the end of the ring overlaps the drum shell secures the ring and thus the sleeve from axial and radial movement.

The drum head or heads are stretched over the drum shell and secured such that their pressure holds the rings in place.

The sleeve is disposed such that there is a small space between the outer surface of the sleeve and the inner surface of the drum shell. A hole is drilled through the sleeve at approximately its mid-point so that there is air communication between the inside of the sleeve and the outside of the sleeve. This hole is positioned to line up with a similar hole disposed in the drum shell.

The above configuration allows the sleeve to resonate when the drum head is struck. By the proper design of the diameter of the sleeve as well as the thickness of the material of which the sleeve is composed, certain beneficial results can be achieved. These include a much higher attack and a much more consistent decay, or overtone.

The novel features which are believed to be characteristic of the invention, both as to its manufacturer and method of operation, together with further objectives and advantages thereof, will be better understood from the following description considered in conjunction with the accompanying drawings in which a presently preferred embodiment of the invention is illustrated by way of example. It is to be expressly understood, however, that the drawings and this description are for the purpose of illustration and description only, and are not intended as a definition of the limits of the invention.

DETAILED DESCRIPTION OF A PREFERRED EMBODIMENT

Figure 1:
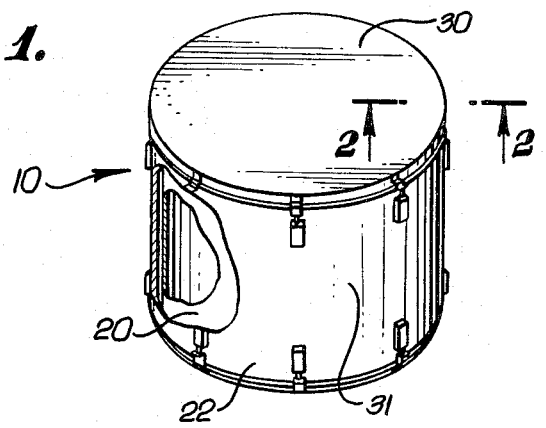
FIG. 1 is a partially cut away perspective view of the new drum construction of the present invention.
Figure 2:
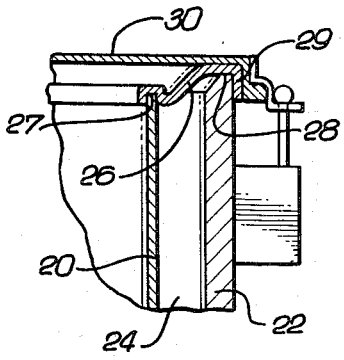
FIG. 2 is a cross-sectional view taken along line 2—2 of FIG. 1.

In FIGS. 1 and 2, is shown a drum constructed in accordance with the present invention. Within drum 10, a tom-tom drum of conventional construction, is a cylindrical plastic sleeve 20, formed by wrapping a sheet of plastic in a cylindrical shape and bonding the edges together. The diameter of the sleeve 20 is designed to be slightly smaller than the inner diameter of the shell 22 of drum 10. The height of the sleeve 20 is also slightly less than the height of the shell 22. When the sleeve 20 is disposed coaxially within the shell 22 there is a small space 24 in between the outer edge of the sleeve 20 and the inner edge of the shell 22.

The sleeve 20 is secured in this position by means of two circular rings 26 at either end of the shell 22. These rings may be produced by making a mold, such as out of plaster and then drawing down the rings 26 using a vac-u-form press. The exact dimensions of the sleeve 20 and the rings 26, both as to thickness, length, and diameter can be adjusted according to the desired effect and the dimensions of the specific drum shell 22 which is being used. As an example, with a 10″×14″ tom-tom drum whose shell 22 thickness is $\frac{1}{4}$″, a sleeve 20, of 0.020″ thickness, and 9-$\frac{3}{4}$″ in height with a $\frac{1}{2}$″ space between the sleeve 20 and the shell 22 may be used. The thickness of the rings 26 is also 0.020″. This will produce a vastly improved tone over the unimproved drum. Of course, different thickness, heights and diameters may be used, even with the same drum to produce varying results depending on what is desired.

At the inner edge of the circular ring 26 is found a groove 27 into which the edge of the sleeve 20 is seated.

The edge of the sleeve 20 is bonded within said groove 27 by an adhesive. The ring then extends upward and outward (or downward in the case of the lower ring 26) to a point even with the edge 28 of the shell 22, at which point it extends outward in a direction perpendicular to the side of the shell 22 to a point where it comes into contact with the edge 28 of the shell 22. A perpendicular flange 29 extends downwardly from the outer edge of said ring 26 and is in contact with the outer surface of the shell 22, thereby securing both the ring 26 and the sleeve 20 from lateral movement. In addition, the sleeve 20 is secured from vertical movement by the contact of both the upper and lower rings 26 with the shell 22.

As can be seen in FIG. 2, the preferred configuration for the edge 28 of the shell 22 is such that it reaches a sharp edge at the outer perimeter of the shell 22 and depends inwardly therefrom. This, along with the shape of the rings 26 which allows the sleeve 20 to flex radially and axially, allows for the maximum resonance by the sleeve 20. Of course, the present invention would improve the resonance of any drum even with a different shape for the rings 26 or a different configuration for the edge 28 of the shell 22. The described configuration and construction is simply a preferred embodiment.

To finish the drum, the heads 30 are then placed over the rings 29 and secured by conventional means. There is a hole 31 at approximately the mid-point of the drum shell 22 to allow air communication between the inside and the outside of the shell 22 as the drum heads flex inwardly and outwardly. There is a similar hole of conventional size disposed in the sleeve 20 which also allows air communication for proper resonance of the sleeve 20.

Figure 3:
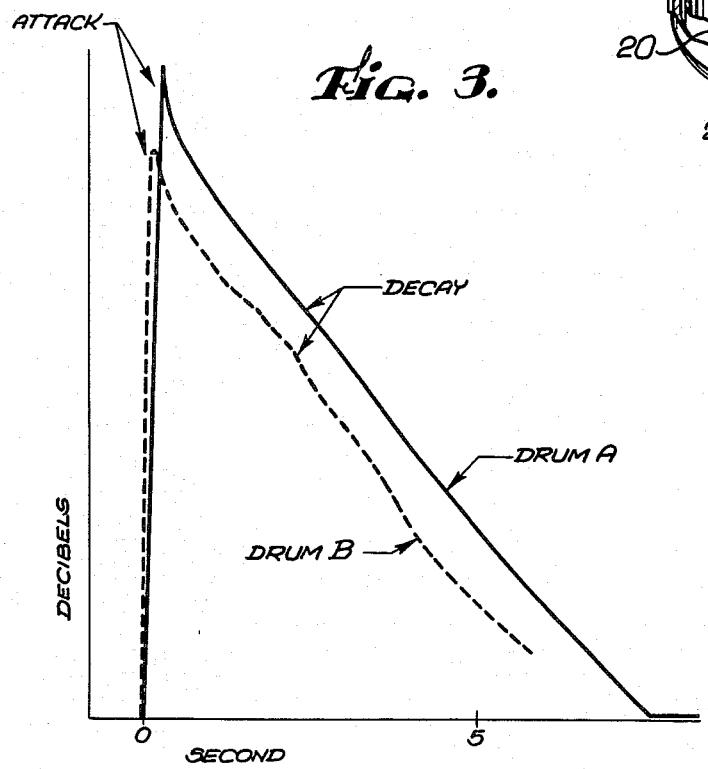
FIG. 3 is a graph comparing the attack and decay of a conventional drum and a drum constructed in accordance with the principles of the present invention.

FIG. 3 presents a graph comparing the attack and decay of a 10×14 CB700 tom-tom drum, and the same drum with the sleeve 20 of the present invention. For this test, the sleeve 20 was made of polystyrene with a thickness of 0.020". The two drums were struck identically with a device designed for that purpose. The conventional drum is identified as drum B and the drum with the sleeve 20 of the present invention is identified as drum A. As can be seen from the graph, the attack of the drum with the sleeve is much sharper than the attack of the conventional drum without the sleeve. This results in a much clearer, more solid sound. In addition, the attack is actually greater in the drum with the sleeve than without the sleeve.

The decay of the two drums is also noticeably different. The decay over time of the conventional drum without the sleeve is uneven and has several humps. This results in an uneven sound. On the other hand, the decay of the drum with the sleeve is much flater and results in a much more even consistent sound.

Figure 4:
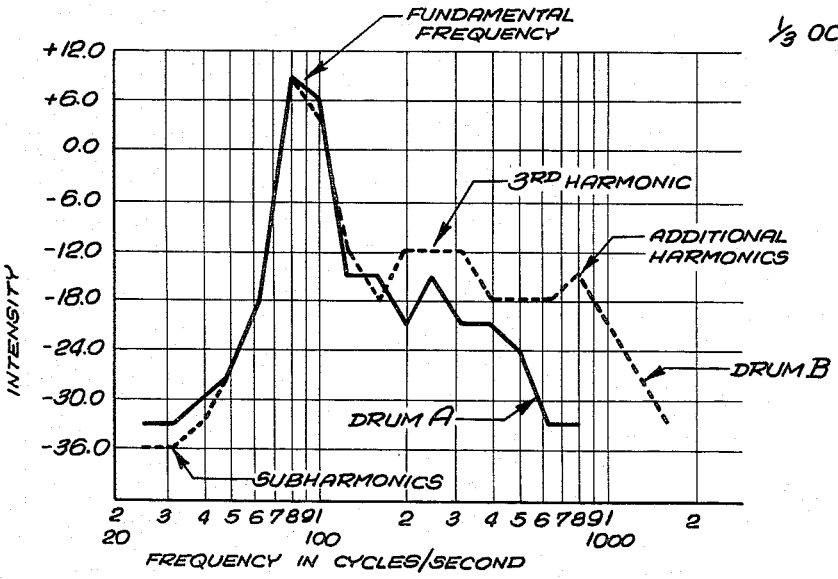
FIG. 4 is a graph comparing the harmonic frequencies of a conventional drum and those of the new drum construction of the present invention.

FIG. 4 displays a one-third octave decay spectrum analysis of the same two drums as were used in FIG. 3. As can be seen, the fundamental frequency of the drums is the same indicating that both drums were identically tuned. However, with drum B, without the sleeve, there are additional harmonics that are not present in drum A, with the sleeve. These additional harmonics result in distortions and lack of tonal purity.

The units in FIGS. 3 and 4 are for comparison only and will vary depending on the type of drum used and the force with which the drums are struck.

A wide variety of materials, shapes and other configurations can be used in this invention. It should be understood that changes can be made without departing from the spirit or scope thereof. For example, in the preferred embodiment the sleeve 20 is composed of 0.020" thick polystyrene. It should be noted that depending on the desired effect and the dimensions of the drum, that different thicknesses and different resonance materials, such as plastics may be used. In addition, while the present invention has been shown with a tom-tom type drum, it is equally adaptable to other drum types, such as a concert tom drum. This invention, therefore, is not to be limited to the specific embodiments discussed and demonstrated herein.

I claim:

1. A musical drum comprising:

a cylindrical shell;

a cylindrical inner sleeve, wherein said inner sleeve is of slightly less diameter and height than said shell, the sleeve being of a material and construction to resonate when the drum head is stuck;

flexible means for disposing the sleeve coaxially within the shell and allowing radial and axial movement of said sleeve so that there is a space between the inner sleeve and the shell of generally uniform width;

a drum head disposed over an open end of the shell; and means securing the drum head onto the shell;

wherein said disposing means comprises two circular rings disposed between said shell and said drum head, said rings having an inner portion and an outer portion, said inner portion of each of said ring being fixedly connected to an edge of said sleeve and said outer portion of each said ring having a flanged projection which extends over an edge of said shell, said rings being movably secured thereby to said shell whereby said rings may vibrate independently of said shell.

2. A musical drum according to claim 1 wherein said rings extends at an angle radially and axially from the edge of said sleeve to the edge of said shell.

3. A musical drum according to claim 1 wherein the edges of said shell are configured such that they form a sharp ridge about the outer perimeter of the shell and depend inwardly therefrom.

4. A musical drum according to claim 1 wherein a small opening is provided in the sleeve and shell so as to allow air communication between the inside and outside of the drum.

5. A musical drum according to claim 1 wherein said sleeve and rings are composed of thin plastic material.

* * * * *